United States Patent [19]

Robillard et al.

[11] 4,268,600

[45] May 19, 1981

[54] PROCESS FOR PHOTOCHEMICALLY COLORING TEXTILES USING PHOTOSENSITIVE TRIAZENE AND COUPLER THEREFOR

[75] Inventors: Jean J. Robillard, Ferney-Voltaire; Claude R. Riou, Gex, both of France

[73] Assignee: Issec and Tissages de Soieries Rennis, France

[21] Appl. No.: 965,437

[22] Filed: Dec. 1, 1978

[30] Foreign Application Priority Data

Dec. 9, 1977 [FR] France ..... 77 37771

[51] Int. Cl.[3] ..... G03C 5/18; D06P 5/02; D06P 1/02; D06P 5/17

[52] U.S. Cl. ..... 430/142; 430/141; 430/147; 430/154; 430/155; 430/170; 430/145; 430/293; 430/294; 430/180; 8/451; 8/466; 8/476

[58] Field of Search ..... 96/49, 75, 91 R, 33; 8/68, 71, 73, 74; 430/147, 170, 141, 154, 155, 141, 142, 293, 294

[56] References Cited

U.S. PATENT DOCUMENTS

| | | | |
|---|---|---|---|
| 1,926,322 | 9/1933 | Van der Grinten | 96/49 |
| 2,541,178 | 2/1951 | Slifken | 96/91 |
| 2,597,306 | 5/1952 | Eaton et al. | 96/49 |
| 2,618,555 | 11/1952 | Reichel | 96/91 R |
| 2,854,338 | 9/1958 | Herrick et al. | 96/75 |
| 3,155,511 | 11/1964 | Jahoda et al. | 96/75 |
| 3,322,541 | 5/1967 | Reichel | 96/33 |
| 3,463,638 | 8/1969 | Damm | 96/49 |
| 3,778,274 | 12/1973 | Inoue et al. | 96/49 |
| 4,055,425 | 10/1977 | Mustacchi | 96/49 |

FOREIGN PATENT DOCUMENTS

| | | |
|---|---|---|
| 915297 | 7/1946 | France . |
| 86438 | 12/1965 | France . |
| 2304101 | 2/1977 | France . |
| 864829 | 4/1961 | United Kingdom . |

*Primary Examiner*—Charles L. Bowers, Jr.
*Attorney, Agent, or Firm*—Stevens, Davis, Miller & Mosher

[57] ABSTRACT

A photochemical color-printing process for textile articles wherein a photosensitive triazene and azo dye coupling agent are applied to surface of textile article, the coated textile is exposed to light with a negative image, unreacted chemical products are removed by washing and rinsing the coated textile article after imaging, and then the coated textile article is dried.

10 Claims, 9 Drawing Figures

Figure 1:
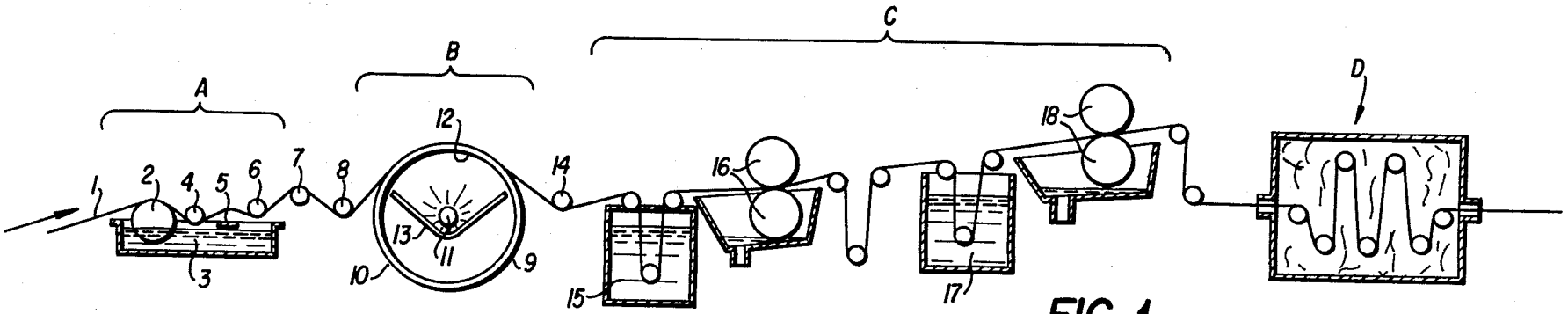

PROCESS FOR PHOTOCHEMICALLY COLORING TEXTILES USING PHOTOSENSITIVE TRIAZENE AND COUPLER THEREFOR

The invention concerns a photochemical colour-printing process, particularly for textile materials; it also relates to a device for carrying out such a process. Finally, it is concerned with textile products, in particular, treated in this way.

Although the invention is particularly described in its application to textile articles, that is to say, for example, to cloths and to garments, it may find other applications, for example, for the printing of plastics.

It has been well known for a very long time to print textile cloths by conventional methods, called "frame process", rotary or otherwise, or "stencil process". However, these techniques, although very widely used, sometimes lack flexibility and require rather bulky and very costly equipment.

French Patent Specifications Nos. 1 223 330 and 1 585 119 describe a process, better known under the name "Sublistatic", which consists in preparing on an intermediate carrier an image of sublimable dyes, which, on heating this carrier in contact with the fabric to be printed, are transferred on to the latter, yielding a stable and durable image. This process has the disadvantage of needing as much surface of intermediate carrier as of cloth to be printed. The preparation of the intermediate carrier can be carried out by photographic means, using an electrostatic process, the toner of which is made up of sublimable dyes, to be transferred on to the cloth, and this operation is effected in three steps, corresponding to the three fundamental colours.

In another way, photochemical printing processes are already known. JOMAIN,—Journal of the Society of Dyers and Colourists, 60, page 661 (1953),—describes, for example, a process using compounds of the "photorapid" diazo-sulphonate type, yielding azo-dyes. FOSTER and KAZAN,—Textile Research Journal, 37, page 376 (1967),—similary describe a process applicable to nylon fabrics, using photochromatic colours, derived from mercury dithizonate. French Patent Specification No. 1 588 282 describes photochromatic fibres, prepared from spiro-pyrans. Finally, French Patent Specification No. 2 270 367 describes a process for photographic printing, using solutions of leuco-derivatives of vat dyes. Unfortunately, all these processes possess, among other shortcomings, that of requiring several successive operations, if it is desired to develop polychromatic designs.

The invention overcomes these shortcomings. It aims at a photochemical printing process, which is easy to carry out, easy to apply to most carriers, especially textiles, and which is able to yield monochromatic as well as polychromatic, especially trichromatic, prints.

The process of the invention is based on utilising the photochemical properties of the triazenes, which, when exposed to light, are capable of yielding a diazo-compound by photolysis, the resulting diazo-compound then being made to react with a suitable coupling agent, so as to yield a colour without any development step. It then suffices to remove excess unreacted triazene by washing and rinsing, in order to finally stabilise the colour.

The use of compositions, based on a triazene and coupling agents, is already well known.

British Patent Specification No. 864 829 already proposes to employ such compositions for textile printing. Nevertheless, selectivity of colour is obtained mechanically in this case, for example, by means of a stencil, and colour development is obtained by neutral or acidic steaming. This type of process is burdensome and costly, as has been said before.

The French Patent Specification, published under No. 2 304 101, has proposed to use such compositions in diazotype printing. If it is desired to obtain a negative image in this case, however, the colour selectivity, obtained by exposure to ultraviolet light, requires stabilisation by an acid treatment, followed by a further uniform ultraviolet exposure and, finally, by a basic treatment. On the other hand, if it is desired to obtain a positive image, not the photochemical decomposition properties of triazenes are called into play any longer, but those of the diazonium salts, obtained by acid treatment of the coating of the starting composition. Here again, the process is burdensome, long and costly and excludes the use of anything other than ultraviolet light.

More particularly, the invention concerns a printing process, in which at least one coat, in basic medium, of a photosensitive composition, comprising at least one triazene and a coupling agent, capable of yielding a colour by reaction with the compound, obtained by photochemical decomposition of the triazene by exposure to light, is applied to a suitable surface of the article to be printed; then the said coat is exposed to light with a suitable negative image. This improved process is characterised in that, following on the said exposure to visible or ultraviolet light, the article, coated with the irradiated layer, is washed and rinsed, so as to remove unreacted chemicals; and, finally, the article obtained is dried.

As is known, triazenes are amino-diazo derivatives of the general formula:

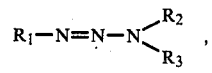

where $R_1$, $R_2$ and $R_3$ denote hydrogen, an alkyl radical or an aryl radical.

Preferably, aryl triazenes are used, that is to say compounds of the general formula

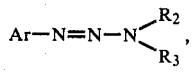

where

Ar denotes an optionally substituted aromatic radical, $R_2$ denotes hydrogen or an alkyl radical and $R_3$ an alkyl radical or an aryl radical, optionally substituted by solubilising groups, such as the —COOH or —$SO_3H$ groups.

The nature of the substituents that may be present on the Ar radical is not critical, inasmuch as these substituents do not prevent the aryl triazene from exercising its function. Triazenes usually exist in the trans-isomer form. Triazenes in the trans-form are sensitive to ultraviolet and blue and, on exposure to actinic light, yield, by photolysis, a diazonium cation, according to the following system:

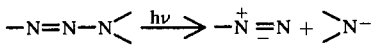

diazonium cation

As soon as it is formed, this cation reacts with the coupling agent, so as to yield a dye responsible for the colour observed on the exposed zones of cloths, photochemically printed according to the invention.

The coupling agents, useful for the invention, are the conventional coupling agents used for azo-coupling in textile applications. The terms "coupling agent", "coupling substance", sometimes called "coupling additive", denote any chemical compound, capable of yielding an azo-dye by an electrophilic aromatic substitution reaction with the diazonium salt, obtained during the photochemical decomposition of the triazene. The coupling agent should therefore, preferably, possess substituents, which, on the one hand, activate this aromatic electrophilic substitution reaction and, on the other, permit of good solubilisation in the medium employed for carrying out the reaction.

The "Color Index" and its supplement describe about a hundred of these agents. Some particular examples are given in Table I below. These coupling agents often are derivatives of Naphthol AS, (2-naphthoic 3-hydroxy anilide), and have the general formula:

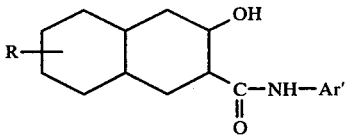

where R is an alkyl or aryl radical and Ar' is a substituted aryl radical.

TABLE I

| Naphthol | Name or Chemical Formula |
|---|---|
| AS | 2-naphthoic 3-hydroxy anilide |
| AS-BG | 2-naphthoic 3-hydroxy 2,5 dimethoxy-anilide |
| AS-BO | 2-naphthoic 3-hydroxy α-naphthylamide |
| AS-BR | 2-naphthoic 3-hydroxy dianisidide |
| AS-BS | 2-naphthoic 3-hydroxy m-nitranilide |
| AS-D | 2-naphthoic 3-hydroxy o-toluidide |
| AS-E | 2-naphthoic 3-hydroxy p-chloroanilide |
| AS-ITR | 2-naphthoic 3-hydroxy 2,4-dimethoxy 5-chloroanilide |
| AS-LC | 2-naphthoic 3-hydroxy 2,5-dimethoxy 4-chloroanilide |
| AS-OL | 2-naphthoic 3-hydroxy o-anisidide |
| AS-PH | 2-naphthoic 3-hydroxy o-phenetidide |
| AS-RL | 2-naphthoic 3-hydroxy p-anisidide |
| AS-SW | 2-naphthoic 3-hydroxy β-naphthylamide |
| AS-TR | 2-naphthoic 3-hydroxy 2-methyl 4-chloroanilide |
| AS-LT | 2-naphthoic 3-hydroxy 2-methyl 4-methoxy-anilide |
| AS-G | 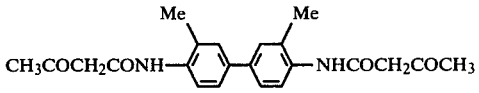 |
| AS-IRG | 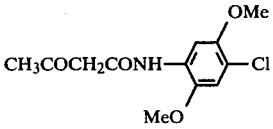 |
| AS-LG | 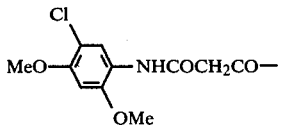 |

TABLE I-continued

| Naphthol | Name or Chemical Formula |
|---|---|
| | 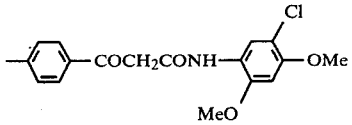 |
| AS-L3G | 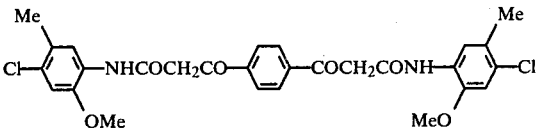 |
| AS-L4G | 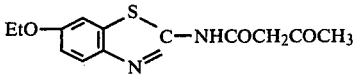 |
| AS-BT | 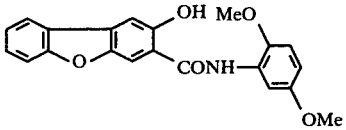 |
| AS-GR | 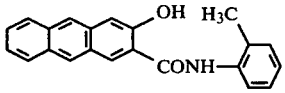 |
| AS-LB | 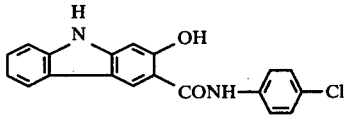 |
| AS-SG | 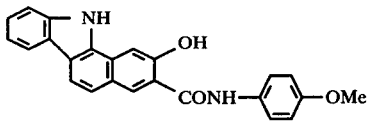 |
| AS-SR | 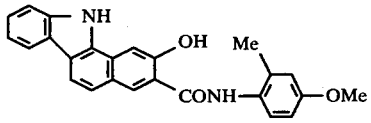 |

The relative proportions of triazenes and of coupling agent are not very crictical and can widely vary. The presence of enough of one of these ingredients, in relation to the other, suffices for a colour of sufficient intensity to develop on exposure. In general, as numerous triazene/coupling agent systems are commercially available, these systems will be employed for reasons of convenience and of cost. Commercial examples of such systems are ROHNER's "Sinagenes" and UGINE KUHLMANN's "Neutrogenes". Clearly, more than one triazene and more than one coupling agent may be incorporated in the coating compositions employed for carrying out the process and the invention, as this is obvious.

Apart from the triazene and the coupling agent, the coating compositions, used in the invention, may contain various ingredients, such as:

solvents, for example: water, alcohol, alone or in admixture; preservatives;

viscosity-modifying agents, capable of being removed on washing, such as derivatives of starch or of cellulose;

complexing agents for the dye formed by the diazo-compound, obtained by decomposition of the triazene and of the coupling agent, for improving its properties and stabilising the dye formed; agents for adjusting the pH of the composition to a basic pH; agents for adjusting the oxidation/reduction equilibrium of the mixture, (for example, sodium bichromate);

agents capable of producing a reduction in pH on irradiation and of thus aiding in the decomposition of the triazene in the irradiated zones; examples: trimethoxyboroxine, phosphorophenyl dihydrochloride, ortho-nitrobenzaldehyde, halogenated hydrocarbons, hydroxylamine hydrochloride, p-sulphonyl nitrobenzene chloride, etc.

All these ingredients can be applied in one or several coatings.

The application of the composition can be effected by any conventional coating means known, for example, by spray-coating, either by spray-gun or with the aid of an atomiser (spray), by bar-coater, by Doctor blade etc. Purely by way of illustration, it will be possible to apply the coating composition according to the invention at the rate of from 0.03 to 30 grams per square meter of textile substrate, based on the triazene/coupling agent system. These quantities shall however not be regarded as critical. In any particular case, an intermediate drying step may be useful before exposure to light.

Exposure with a negative image can be effected by using as source of light, according to the case, either a source of visible light, in the case of a sensitized emulsion, or, when the emulsions are not sensitized, a source of actinic light or any other source, at least part of the emission spectrum of which is in the near-ultraviolet or the near-visible range, (from 300 to 450 nm). By way of particular examples, the Philips tube TL/05 and the Philips lamp HPR 125 may be cited. The exposure period will vary, depending on the nature of the particular triazene employed, of the power of the light source employed, of the distance between the source and the article etc. In each ease, a simple experiment will enable those skilled in the art to determine convenient working conditions.

Exposure is effected in a known manner, with a negative in contact with the coat or projected by transmission or reflection on the latter. According to the case, this negative is a black, white or coloured film, prepared by conventional techniques, depending on the image to be reproduced.

As has been said, exposure is effected, in the case of sensitized emulsions, with a negative, expecially a coloured negative; that is to say, with a possibly transparent carrier, on which the original colours of the print pattern are reproduced in colour and in density by their complements.

The washing and rinsing step can be effected in any suitable manner. The choice of solvent is guided by the need of removing products, which have not reacted photochemically, from the carrier. For example, washing may be carried out in a hot aqueous detergent solution, followed by pressing, then rinsing with hot water, so as to remove traces of detergent, followed by pressing.

Advantageously, washing takes place with cold or tepid water, so as to avoid a thermal reaction of any unreacted triazene.

Drying is effected, in practice, by passing through hot air or under an infra-red lamp.

It is well known in the conventional printing methods for textiles to employ dyestuff systems, based on aryl triazeness and coupling agents. Such systems are sold in the trade, for example, under the brand "Sinagene" by the ROHNER Company or under the brand "Neutrogene" by the UGINE KUHLMANN Company. These dyestuff systems mostly require a colour development step by heating or steaming. This steaming process is effected in neutral medium in the best cases and, frequently, in more or less acidic medium, which raises rather important pollution problems.

If it is desired to develop a monochromatic print, that is to say in a single colour, the process as defined above is applied in a single run.

If it is desired to develop a polychromatic print, for example in three colours, the runs of the process are repeated as many times as desired, using a different triazene/coupling agent system each time, yielding the colour desired, and carrying out the exposure for a desired image for the colour in question through a suitably chosen negative. After final drying, an article in fast colour is obtained. Colour photographs can be reproduced on textile articles in this way.

The invention also concerns a polychromatic printing process, in which several superimposed layers, each containing colour-generating compounds, are applied to the surface of the article to be printed in a known manner, (cf., for example, U.S. Pat. No. 2,541,178). This improved process is characterised in that it comprises the following steps:

First of all, a first photosensitive coating, formed by a composition based on a triazene and a coupling agent, capable of yielding a first fundamental colour on exposure to actinic light, is applied to an article; then the coating obtained is exposed with a chosen design to actinic light, through a first three-colour selection negative, corresponding to the colour given by this first composition then it is washed and rinsed;

subsequently, a second photosensitive coating, formed by a composition, based on a triazene and a coupling agent, capable of yielding a second fundamental colouron expsoure to actinic light, is applied to the article obtained; then this second coating is exposed with a chosen design to actinic light through a second three-colour selection negative, corresponding to the colour given by this second composition, then it is washed and rinsed;

Afterwards, a third photosensitive coating, formed by a composition, based on a triazene and a coupling agent, capable of yielding a third fundamental colour on exposure to actinic light, is applied to the article obtained; then this third coating is exposed with a chosen design to actinic light through a third three-colour selection negative, corresponding to the coating given by this third composition, then it is washed and rinsed;

finally, the article obtained is dried. In another embodiment, the photosensitive composition contains, in addition:

at least one sensitizer for the decomposition of the triazene in visible light and, at least, one chemical compound, polymerisable under the influence of an irradiation and of the sensitizing agent; the triazene and the coupling agent yielding, by decomposition and coupling, a dye of complementary colour to the sensitizing colour.

The terms "sensitizing agent", "sensitizer" or "sensitizing dye" denote a chemical compound, which, on receiving light energy in its absorption band, passes into an excited state and is subsequently deactivated, transferring the corresponding energy to another chemical system, which would not be directly affected by the light energy absorbed by the sensitizer. If the light energy, absorbed by the sensitizer, is situated within the visible wavelength range, this sensitizer will be a dye by definition.

These sensitizing agents, some examples of which are given in Table II, on the one hand transmit their excitation energy to the triazene for decomposing it and, on the other, initiate the polymerisation of the polymerisable compound, such as, for example, a monomer or a prepolymer, at any rate in the exposed zones. This polymerisation has the purpose of making mechanical attachment of the dye formed on exposure to the article to be printed possible. Polymerisation of the monomer or prepolymer compound in the exposed zones is promoted by the decomposition of the triazene. In fact, it is probable that this latter is brought about by radical intermediate groups and that these are able either to initiate polymerisation or to accelerate the latter, if it has already started.

Subsequently, it is enough to remove from the article the undecomposed triazenes, the coupling agents as well as the molecules of unpolymerised compounds, all these products being located in the zones that have not been illuminated by a wavelength corresponding to sensitization.

In other words, the use of sensitizers for the decomposition of the triazene in visible light is advantageous for carrying out colour printing, especially the three-colour process, in a single exposure.

TABLE II

| FOR BLUE | absorption maximum in nm | class of dye |
|---|---|---|
| Alizarin yellow G | 371 | 1 Az |
| Lissamine fast yellow | 396 | 1 Az |
| Titan yellow | 404 | TL |
| Acetoquinone yellow 5 JE | 400 | N |
| Quinoline yellow KT | 414 | Q |
| Lissamine flavine FS | 416 | Amn |
| Solochrome azurine B | 424 | HTPM |
| Auramine O | 430 | DPM |
| Alizarin | 428 | Aq |
| Sirius orange G | 440 | 2 Az |
| Aurophosphine | 452 | AC |
| Thioflavin chloride | 460 | TL |
| 2,2'-thiacyanine 3,3' diethyl iodide | 430 | C |
| **FOR GREEN** | **maximum** | **class** |
| Congo red | 486 | 2 Az |
| Indanthrene Bordeaux B | 489 | Aq |
| Eriochrome violet | 496 | 1 Az |
| Sudan R | 496 | 1 Az |
| Supranol Blue BL | 503 | An |
| Erythrosin Y | 504 | X |
| Procion red MGS | 508 | R |
| Neutral red | 529 | An |
| Benzopurpurin 10 B | 515 | 2 Azo |
| Eosin Y | 517 | X |
| Safranin O | 517 | An |
| Solochrome cyanine R | 518 | HTPM |
| Rose Bengal | 544 | X |
| 2,2'-thiacarbocyanine 3,3'-diethyl iodide | 550 | C |
| 2,4'-monomethine cyanine(1'-ethyl quinoline)(3-ethyl benzothiazole) iodide | 500 | C |
| 2,2'-cyanine 1,1-diethyl iodide | 510 | C |
| Acridine orange | 491 | Ac |
| **FOR RED** | **maximum** | **class** |
| Crystal violet | 593 | TPM |
| Thionine | 596 | Tn |
| Janus green | 600 | 1 Az |
| Toluidine blue | 632 | Tn |
| Supracen blue SES | 632 | Aq |
| Methylene blue | 655 | Tn |
| Procion brilliant blue H-RGT | 667 | Aq |

TABLE II-continued

| | | |
|---|---|---|
| Sirius supra green BB | 680 | 3 Az |
| Naphthol green B | 690 | Ns |
| 4,4'-dicarbocyanine (1'-ethyl quinoline) 6-nitro 3-ethyl benzothiazole)chloride | | C |
| 4,4'-dicarbocyanine 1,1'-diethyl iodide | | C |
| 4,4'-dicarbocyanine 1,1' diethyl iodide | 735 | C |
| 2,2'-thiadicarbocyanine 3,3'-diethyl iodide | 635 | C |

1 Az = Monoazo
TL = Thiazole
N = Nitro
Q = Quinoline
Amn = Aminonaphthalimide
HTPM = Hydroxydinaphthylmethane
DPM = diphenylmethane
Aq = Anthaquinone
Ac = Acridine
An = Azine
X = Xanthine
R = Reactive
TPM = Triphenylmethane
Ns = Nitroso
C = Cyanine
2 Az = disazo
3 Az = trisazo In an embodiment adapted to the three-colour process:

First of all, a first photosensitive coating, consisting of a composition containing at least one triazene and one coupling agent, capable of yielding, on exposure to light, a first complementary colour of the sensitizing colour, a sensitizer and at least one compound, polymerisable under the influence of exposure to light, so as to fix the first dye formed, is applied to the article;

then a second photosensitive coating, consisting of a composition containing at least one triazene and one coupling agent, capable of yielding, on exposure to light, a second complementary colour of the sensitizing colour, a sensitizer and at least one compound, polymerisable under the influence of exposure to light, so as to fix the second dye formed, is applied to the coat formed;

then a third photosensitive coating, consisting of a composition containing at least one triazene and one coupling agent, capable of yielding, on exposure to light, a third complementary colour of the sensitizing colour, a sensitizer and at least one compound, polymerisable under the influence of exposure to light, so as to fix the third dye formed, is applied to the coat formed;

subsequently, these superimposed layers are exposed to light, with a coloured negative of the image to be reproduced;

subsequently, it is washed with a compound, which is a solvent of the monomers or of the prepolymers, but a non-solvent of the polymers formed by the polymerisation of this compound;

and, finally, the article obtained is dried in conditions adequate for removing the solvents and fixing the three dyes obtained.

Advantageously, slight drying is carried out after the application of each coating composition and overall exposure to visible light is carried out, care having been taken of choosing triazenes, the decomposition of which is sensitized at wavelengths situated in the visible range.

These triazines, therefore, yield, by photolysis, diazo-compounds, which directly react with the coupling agent, so as to produce an immediately visible colour, without any development step.

In practice, the triazene/coupling agent composition, optionally with additives, is a basic solution in a water-/alcohol mixture. Good results are obtained with compositions containing from five to ten percent by weight of dry products and by working at a pH of at least 10.

Washing and rinsing, for the purpose of removing the unreacted reagents, should not make dissolution of the polymer formed possible.

Besides, the final drying is carried out in conditions adequate for making the drying of the printed article and the fixing of the polymer, containing the dye, possible.

Exposure with a coloured negative is effected either by projection or by contact, if the negative is transparent, or by reflection, if the negative is opaque, with the aid of white light, (tungsten lamp, flash, etc). The period of this exposure varies with the nature of the composition and the power of the source of white light. Those skilled in the art can easily determine the optimum working conditions for each particular case.

In another embodiment of the invention, the triazene/coupling agent/sensitizer assembly is deposited by adsorption, or rather by coating, on a pigment that is inert in the working condition, for example, $TiO_2$, $SiO_2$, $Al_2O_3$, ZnO, $SnO_2$.

As previously, each elementary assembly develops the complementary colour of the sensitization. There is, for example, one assembly sensitive to green, one to red and the other to blue and pigments sensitive to each colour are emulsified in a polymerisable compound, (monomer or prepolymer), the polymerization of which is sensitized in the visible range.

This mixed pigment composition is deposited on the article to be printed, dried and then exposed to light. This irradiation, on the one hand, polymerises the resin in the exposed places and, on the other, selectively decomposes, in relation to wavelength, the triazenes, according to the sensitized colours.

Subsequently, washing is carried out in conditions adequate for:

removing polymerisable but not polymerised compounds;

removing unreacted pigments;

extracting unreacted pigments from polymerised places.

Finally, drying is carried out as previously.

As has already been said, the invention is particularly adapted for textile articles of any kind, (natural or synthetic fibres), alone or in admixture, in widely differing forms, such as woven, knitted and non-woven cloths, ready-made garments or other accessories, such as ties, scarves, socks, stockings etc.

The invention similarly concerns a device for carrying out this process.

This device is characterised in that it comprises:

means for applying on an article to be decorated at least one photosensitive coating, consisting of a composition containing at least one triazene and one coupling agent;

means for irradiating the deposited coat with light;

means for washing the irradiated coat; and means for drying the article obtained. In an improved version this device comprises, in addition:

means for continuously feeding the article to be printed;

and means for continuously receiving the printed article.

The manner, in which the invention can be put into practice, and the resulting advantages will become clearer from the following embodiment examples, with the aid of the accompanying figures, the whole being given by way of non-limiting illustration.

FIG. 1 diagrammatically illustrates an equipment for carrying out the process of the invention in single colour or in three colours in successive phases, in which exposure to light is made by contact with a transparent negative.

Figure 2:
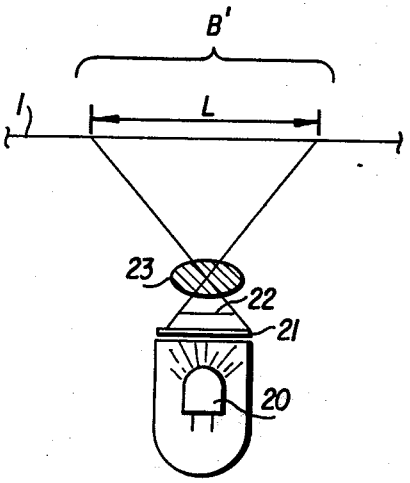

FIG. 2 represents a variant of the irradiating element, in which exposure is made by projection through a transparent negative element.

Figure 3:
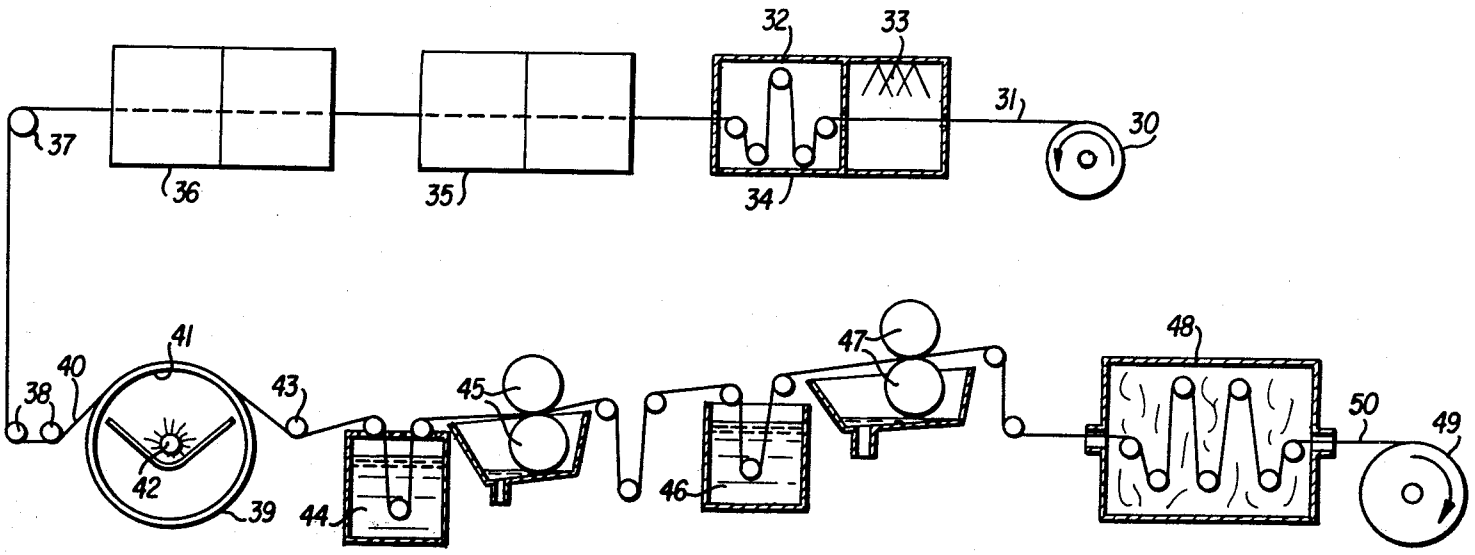

FIG. 3 diagrammatically shows another form of equipment for the three-colour process in a single phase of the process according to the invention.

Figure 4:
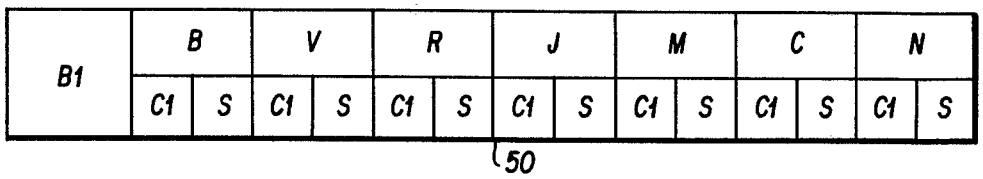

FIG. 4 diagrammatically represents a coloured photographic original.

Figure 5:
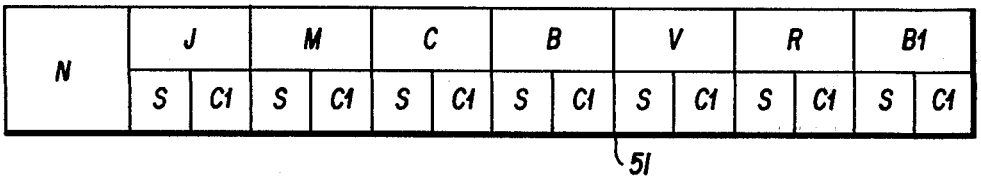

FIG. 5 shows a coloured negative of this original.

Figure 6:
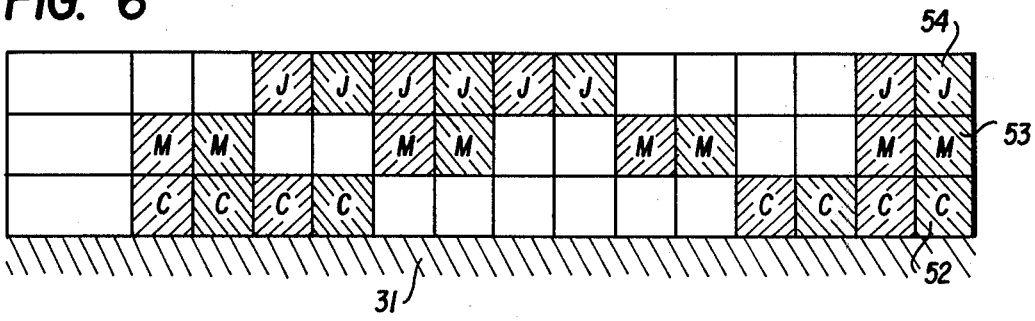

FIG. 6 diagrammatically represents the different coats after exposure to light.

Figure 7:
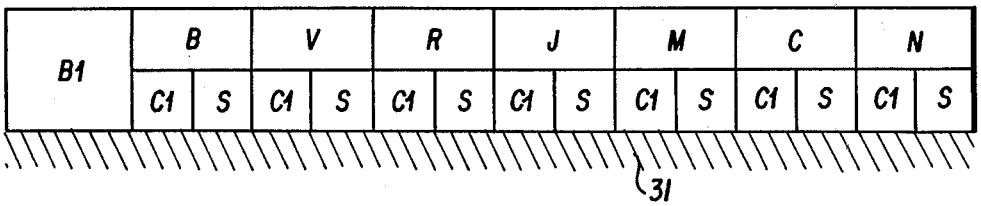

FIG. 7 reproduces the result obtained.

Figure 9:
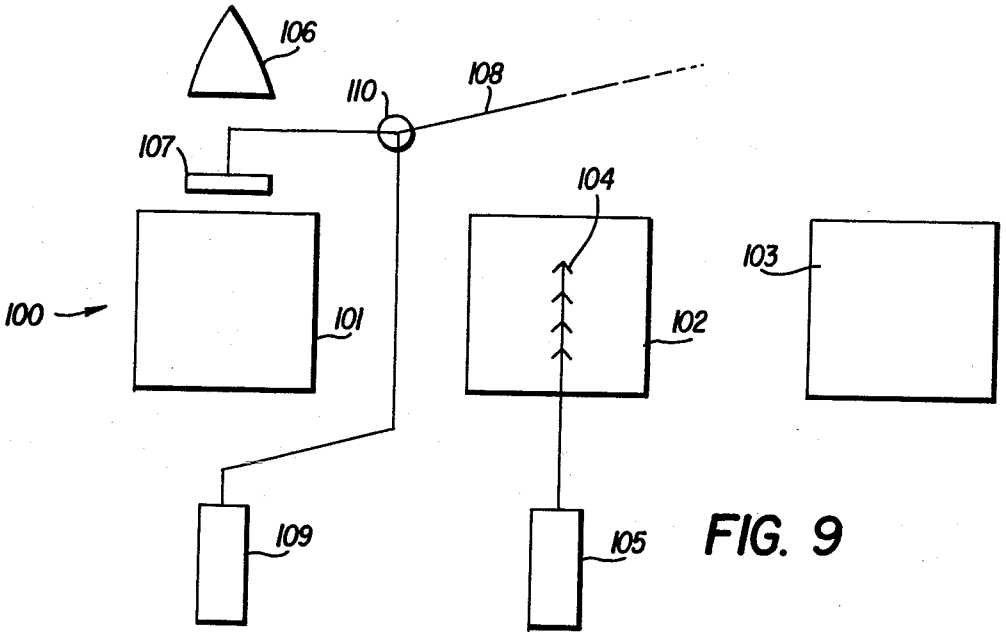
Figure 8:
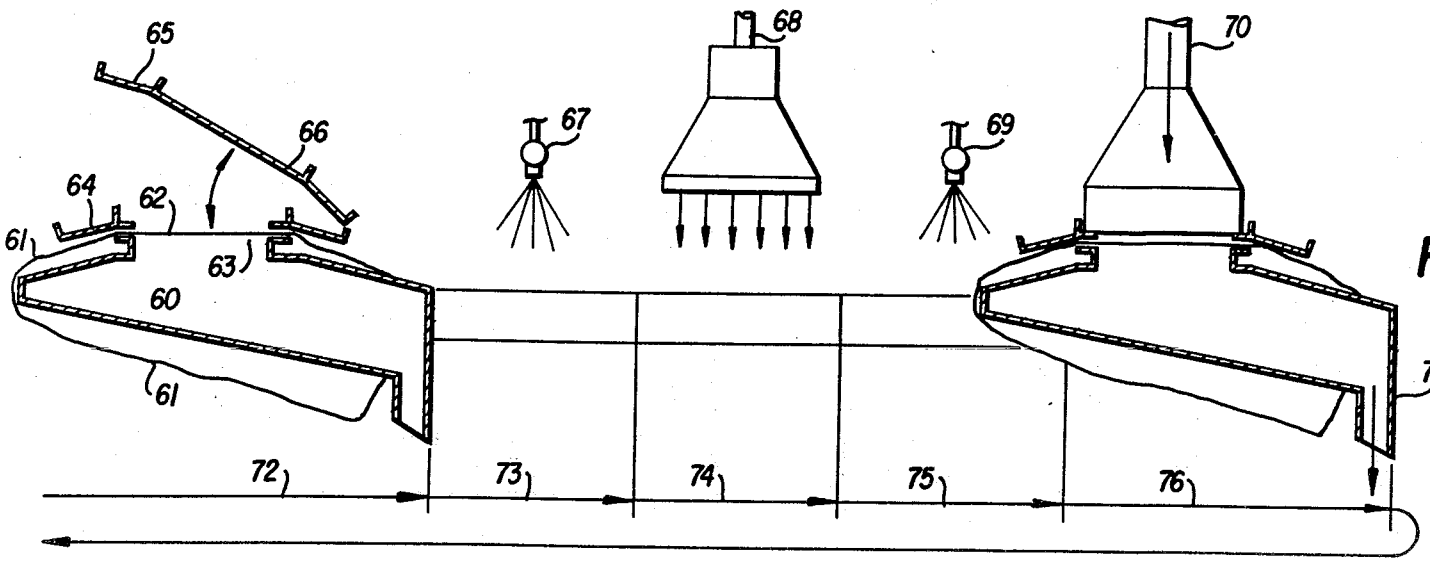

FIGS. 8 and 9 each illustrate apparatus for carrying out the invention.

EXAMPLE 1

The following photosensitive composition I is prepared by thoroughly mixing, in a mixer, for example the Ultra-Turrax type, the constituent ingredients:

Sinagene Blue B (powder): 50 g
Urea (complexing agent): 50 g
Ethanol (solvent): 50 g
Water @ 50° C.: 340 g
Aqueous caustic soda solution, 32%: 12 g
Solvitose C5, 12% (binder): 500 g Sinagene Blue B (powder) is a mixture of amino-diazo compound (aryl-triazene) and of coupling agent, sold under this brand by ROHNER. The urea plays the part of a complexing agent for the dye formed on exposure, which enhances its brilliancy and its fastness. The ethanol and the water are solvents for the composition. The 32% caustic soda serves to render the composition basic, so as to obtain better stability of the composition, since the triazene is decomposed and reacts with the coupling agent in neutral or slightly acid medium. Solvitose C5 is a thickener, based on esterified starch, making it possible to obtain a suitable viscosity for the composition. This produce is sold under this brand by W. A. SCHOLTEN's CHEM. FABRIEKEN, Foxhol (Holland).

A piece of polyester (67%)/cotton (33%) fabric 1, weighing eighty grams per square metre, coming from a bobbin (not shown), arrives at a coating device A, comprising a coating roller 2, partially immersed in a bath 3 of the above prepared photosensitive composition in such a way that its bottom surface is covered with the said composition. The device A comprises an assembly, comprising a roller 4, a bar coater 5 and a roller 6, this assembly being adjustable, so as to be able to regulate the thickness of the photo-sensitive composition layer, deposited on the fabric 1 by the roller 2, by removing any undesirable excess of this composition, as this is well known. About 8 g of composition are applied per square meter of fabric with the aid of the coating device A.

The coated fabric subsequently passes on to idle rollers 7 and 8, then reaches a continuous exposure device B by contact, comprising a rotary cylinder, the cylindrical surface 9 of which, in contact with the fabric 1 and made of transparent plastics, carries the transparent negative element 10, the image of which is to be reproduced on the fabric. At the center of this cylinder 9 and parallel to the axis of the latter, a source 11 of actinic light, having tubular shape, is mounted, such as a Philips tube TL/05, in fixed position, illuminating only the arc 12 of the cylinder 9, which is in contact with, or in the immediate vicinity of, the fabric 1. This arc can have any range desired, for example, in the order of 90°. To this end, the field of action of the source 11 is limited by a fixed screen 13, having the general shape of an inverted V, the tip of which surrounds the said source and the ends of the branches of which reach the limit points of the arc 12.

The working of the exposure device B is the following:

As the rotary cylinder is driven in rotation in clockwise direction at a peripheral speed equal to the speed of movement of the fabric 1, the source 11 illuminates only the arc 12 and the portion of the negative element 10, covering this arc. The illumination of a given point of the said portion of the negative original and the accompanying exposure of the fabric 1 through this point lasts throughout the period, during which the said point moves along the arc 12, given the fact that the rotation of the cylinder 9 and the movement of the fabric 1 are synchronous. In this way, continuous exposure of the substrate is obtained through the various points of the negative element 10, in proportion to the rotation of the cylinder 9.

With a cylinder of 80 cm diameter,—tubular source placed about 40 cm from the fabric,—an illuminated arc range of about 90° and a speed of movement of the fabric and a peripheral speed of the cylinder of 20 mm/sec., the period of exposure of a given point of the fabric was about 30 seconds and immediately generated the pattern of the transparent negative element in a beautiful blue colour on the fabric.

On leaving the exposure device B, the coated fabric passes on to an idle roller 14, then reaches a washing and rinsing device C. In this device C, the impregnated fabric successively passes into a washing-tank 15, filled with water, containing a detergent, the role of which is to remove the unreacted excess aryl triazene, then between two squeeze-cylinders 16, which remove the greater part of the water absorbed by the fabric, then into a rinsing tank 17, filled with hot water, the role of which is to remove residual detergent, and, finally, between two squeeze-cylinders 18, removing the greater part of the water absorbed by the fabric.

Finally, the fabric, leaving the device C, passes into a drying device D, which it leaves ready for use.

EXAMPLE 2

Instead of the continuous exposure device B by contact, represented in FIG. 1, the discontinuous exposure device B' by projection, represented in FIG. 2, is used. This exposure device B' comprises a source of actinic light 20, for example a Philips lamp HPR 125, a screening device 21, such as a diaphragm, capable of stopping radiations, emitted by the source 20, or letting them pass, a transparent negative element 22 and an objective 23, and projects on to the fabric 1 an image of length L and of width corresponding to that of the cloth to be printed, as shown. With this device, printing is carried out discontinuously, with a surface of length L, corresponding to the length of the image projected by the device B'. For this purpose, it suffices to move discontinuously the cloth 1 by a distance L each time, the screening device 21 being open during exposure,—cloth stationary,—and closed during the movement of the cloth. The exposure period for the coated film of Example 1 can be about 30 seconds, the source 20 being located 30 cm from the fabric.

An unbroken print, formed by juxtaposition of image units of length L, is thus obtained on the cloth.

EXAMPLE 3

This example illustrates the production of a colour print (trichromatic). A piece of textured polyester crepe fabric, weighing fifty-five grams per square meter, is coated with the following photosensitive composition II, at the rate of 8 g/m$^2$, approximately.

Composition II

Sinagene Red G (50% solution): 120 g
Water @ 50° C.: 370 g
Caustic soda (32% aqueous solution): 100 g
Neutral chromate solution: 10 g
Meyprogum CRX (5% aqueous solution): 500 g Sinagene Red G (50% solution) is a mixture of an amino-diazo compound (aryl-triazene) and of a coupling agent, completely dissolved and sold under that brand by ROHNER in the form of a 50% water/alcohol solution. The neutral chromate solution is made up of 150 parts of sodium bichromate, of 725 parts of water and of 125 parts of caustic soda, 38° Be, (approximately 32%), and serves as oxidising agent, protecting the composition from exterior reducing influences, which could be harmful to its stability. Meyprogum CRX (5% in water) is a thickener, based on esterified carob, serving to adjust the viscosity of the composition. This product is sold under that brand by MEYHALL CHEMICAL S.A., Kreuzlingen (Switzerland).

The cloth, coated with composition II, is exposed by projection through a colour selection negative for red, using a source of actinic light, and a red pattern is obtained on the cloth.

The washing-pressing-rinsing-pressing operations are subsequently carried out, as described in Example 1.

The cloth is then coated with the following photosensitive composition III, again at the rate of 8 g/m$^2$, approximately.

Composition III

Sinagene Green B (powder): 50 g
Urea (complexing agent): 50 g
Ethanol (solvent): 50 g
Caustic soda (32% aqueous solution): 12 g
Meyprogum CRX (5%) (binder): 500 g
Water @ 50° C.: 350 g The cloth, coated with Composition III, is exposed by projection through a colour selection negative for green, using a source of actinic light, and the appearance of the green dye is seen on the cloth. The washing-pressing-rinsing-pressing operations are then performed, as described in Example 1.

The cloth is then coated with the following photosensitive composition IV, at the rate of 8 g/m$^2$, approximately.

Composition IV

Brilliant Neutrogene Marine R, solution: 120 g
Water @ 50° C.: 370 g
Neutral chromate solution, described for Composition II: 10 g Meyprogum (5%) (binder): 500 g
Caustic soda (50% aqueous solution): 100 g The Brilliant Neutrogene Marine R solution is a mixture of aryl triazene and of coupling agent, both solubilised in a water/alcohol mixture and is sold under that brand by PECHINEY-UGINE-KUHLMANN.

The cloth, thus coated, is exposed by projection through a colour selection negative for blue, using a light source, and, in this way, a colour image (trichromatic) of good quality is produced on the cloth. The washing-pressing-rinsing-pressing operations are then performed, as described in Example 1 and the process is finished by passage through a drying device D, so as to obtain drying, on the one hand, and on the other, fixing of the dyes, that is to say a printed cloth, ready for use.

The different operations of coating, of exposure and of washing-pressing-rinsing-pressing can be performed with devices, such as the devices A, B' and C, described in Example 1 and arranged in succession to one another, a drying device D, as described in Example 1, being provided in the end position. Thus, for a three-colour print, there will be the following sequence of devices: $A_1$-$B'_1$-$C_1$-$A_2$-$B'_2$-$C_2$-$A_3$-$B'_3$-$C_3$-D, the index FIGS. 1, 2 and 3 each referring to the printing of one of the three fundamental colours. It is understood that it is expedient to adjust carefully the position of the cloth for the successive exposures, so as to avoid inopportune slipping between the three superimposed fundamental images, as this is well known in the field of colour printing.

EXAMPLE 4

It is desired to produce a monochromatic print by spray application on a fabric. To this end, the following composition is thoroughly homogenised with the aid of a mixer (Ultra-Turrax type or other), or of a paddle-stirrer or of any other suitable system:

Sinagene Red R (50% solution): 50 g
Water (50° C.): 400 g
Aqueous caustic soda solution (32%): 40 g
Neutral chromate solution: 4 g This solution is sprayed with the aid of a suitable nozzle, with compressed air, on to a knitted cotton (100%) cloth, weighing 150 g/m$^2$. The feed rate is adjusted with regard to the properties of the nozzle and to the speed of passage of the cloth, so that deposition of composition is about 8 g per square meter.

Subsequently, the cloth is exposed with the aid of a contact exposure device as in Example 1 or with the aid of a discontinuous projection device as in Example 2.

On leaving the exposure device, the cloth is washed, rinsed and dried, as in Example 1, and a red print is thus obtained on the cotton cloth.

EXAMPLE 5

It is desired to produce a monochromatic print from another triazene. For this purpose, the composition

| | |
|---|---|
| 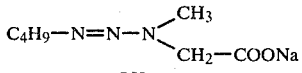 | 25 g |
| 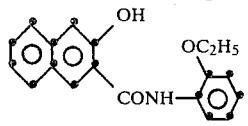 | 25 g |
| Urea | 50 g |
| Ethanol | 50 g |

-continued

| | |
|---|---|
| Water @ 50° C. | 350 g |
| Aqueous caustic soda solution, 32% | 12 g |
| Neutral chromate solution | 10 g |
| Solvitose C5, 12% | 500 g |

is homogenised as in the preceding examples.

Coating is effected in the same conditions as for Example 1. Exposure, washing, rinsing and drying are effected as in the preceding examples and an orange-brown print is thus obtained on the fabric.

EXAMPLE 6

It is desired to produce a monochromatic print from a solution containing a product, capable of generating an acid on irradiation. For this purpose, the same solution as in Example 1 is used, to which 1% by weight of a 5% aqueous solution of hydroxylamine hydrochloride has been added.

Coating is carried out in the same way as in Example 1 and in the same conditions. Addition of the compound, generating acid on irradiation, makes it possible to reduce the time of exposure by two, in relation to Example 1, all other things being otherwise equal. Washing, rinsing and drying are effected as in Example 1 and a blue print is obtained on the fabric.

EXAMPLE 7

In this case, the compound, generating acid on irradiation, is incorporated in a first coat. Homogenising is carried out in the same manner as previously; then a piece of polyester (67%)/cotton (33%) fabric, 80 g/m$^2$, is coated, in the same way as in Example 1, with the composition:

p-Sulphonyl nitrobenzene chloride: 1 g
Polyvinyl alcohol, 15% in water: 10 g
Water: 10 g,
at the rate of 5 g/m$^2$, approximately.

The composition of Example 1 is deposited on top of this coat. The results obtained are identical with those of Example 6.

EXAMPLE 8

It is desired to produce a trichromatic print in a single run on a cloth. In order to do this, the device of FIG. 3 is employed, in which:

30 denotes the bobbin of textured polyester crepe fabric 31;
32 a first chamber formed by two compartments in series;
33 a chamber for spraying, for example, by spray-gun, and
34 a chamber for drying, for example, with circulating hot air;
35 and 36, respectively, a second and third chamber, similar to 32;
37 and 38 idle return rollers;
39 an exposure cylinder, (similar to 9 in FIG. 1), in contact with the fabric 40, coated with its three layers and carrying a colour negative 41;
42 the source of white light, such as a tungsten filament lamp;
43 a return roller;
44 and 46 washing tanks;
45 and 47 squeeze-rollers;
48 a heating-chamber, for example with circulating pulsed hot air; and 49 a receiver-bobbin for the printed fabric 50, synchronous with 30.

In the chamber 32, the following composition is sprayed with the aid of the spray-gun 33, at the rate of about 6 g of composition per square meter of fabric, this composition having been previously homogenised with the aid of a mixer or of a paddle-strirrer:

Sinagene Green B powder: 20 g
Sinagene Blue B powder: 30 g
Urea: 50 g
Ethyl alcohol: 100 g
NaOH solution, 32%: 12 g
Water @ 50° C.: 300 g
Meyprogum CRX, 5%: 50 g
Acrylonitrile: 10 g
Methylene Blue, 1% in water: 0.5 g The acrylonitrile is a monomer, soluble in the water/alcohol mixture, which, on polymerisation, yields the water-insoluble polyacrylonitrile.

This coating corresponds to the composition sensitized for red and, therefore, must develop a cornflower blue colour.

This composition is dried in the drying-chamber 34.

In the chamber 35, a second composition of the following formulation is sprayed, also at the rate of approximately 6 g of composition per square meter of fabric, this composition having been previously homogenised with the aid of a mixer or of a paddle-stirrer:

Sinagene Red R (50% solution): 60 g
Sinagene Bordeaux BR (50% solution): 40 g
Urea: 20 g
Ethyl alcohol: 100 g
NaOH solution, 32%: 12 g
Water @ 50° C.: 250 g
Neutral chromate solution: 10 g
Meyprogum CRX, 5%: 50 g
Acrylonitrile: 10 g
Safranin O, 1% in water: 0.5 g This coating corresponds to the composition sensitized for green and, therefore, must develop a magenta colour.

This composition is dried in the corresponding drying-chamber. In the chamber 36, a third composition of the following formulation is sprayed, also at the rate of approximately 6 g of composition per square meter of fabric, this composition having been previously homogenised with the aid of a mixer or of a paddle-stirrer:

Sinagene Yellow: 50 g
Ethyl alcohol: 100 g
NaOH solution, 32%: 12 g
Water @ 50° C.: 300 g
Neutral chromate solution: 10 g
Meyprogum CRX, 5%: 50 g
Acrylonitrile: 10 g
Thioflavin chloride, 1% in water: 0.5 g This coating corresponds to the composition sensitized for blue and, therefore, must develop a yellow colour.

This composition is dried in the corresponding drying-chamber.

Intermediate drying in the chambers 32, 35 and 36 is effected in conditions adequate for removing the maximum of solvent.

With reference to FIGS. 4 to 7, the working process is the following:

The following letters indicate the colours:

B1=white
N=black
B=blue
V=green
R=red
J=yellow
M=magenta
C=cornflower blue
C1=light
S=dark and the shaded portions represent density; low, if spaced, high, if dense.

A photographic original (FIG. 4), for example a colour photograph, is initially used.

This original 50 is transposed in a known manner, (FIG. 5), on to a negative 51, for example on to a transparent polyester film, on which the complementary colours and densities are obtained.

FIG. 6 shows:

the base fabric 31;

the three coatings of photosensitive composition 52, 53, 54. coming, respectively, from the three sprayers 33, 35 and 36.

When the coat 54, which has been sensitized for blue, is exposed to blue light, it develops a yellow colour. Similarly, what was black (N) on the negative does not let anything pass through and, therefore, remains white on the coat (B1) after wasing, rinsing and drying. If, on the other hand, irradiation takes place through the yellow region of the negative, the dark (S) zones let little light pass and the corresponding zones of the coatings, sensitized for green and red, will, therefore, show a weak reaction; a light hue will be obtained in this way. On the other hand, the light zones are strongly penetrated and will make the corresponding parts of the coats, sensitized for green and red, react strongly; a dark colour will be obtained in this way.

FIG. 7 shows the result obtained. As previously, exposure to light has promoted decomposition of the triazene, then formation of the dye, simultaneously with the polymerisation of the monomer or of the prepolymer. On washing, the unpolymerised portions have been removed, as well as undecomposed triazene. Besides, heating has finally promoted the fixing of the dye to the fabric.

EXAMPLE 9

Example 8 is repeated, surface-active agents, suitably chosen from among the following different classes, being added to each composition, in such a way that the surface tension of each coating is sufficiently modified, so that there is no mixing:

surface-active agents of the anionic type: these are mainly carboxylates, the carboxyl group of which is attached to a hydrophobic group, either directly or by way of an ester bridge, amide bridge or sulphonamide bridge;

surface-active agents of the cationic type: most frequently aminoderivatives, quaternary ammonium salts, guanidine derivatives . . .; non-ionic surface-active agents, whigh are organic substances, containing groups of different polarity; for example, polyethylene glycol, polyethers, polyesters, polyhalogenated compounds, colloidal substances, graphite, metals . . . , macromolecules.

In this way, it is possible to reduce, or even do away with, the preliminary drying in the chambers 32, 35 and 36.

FIG. 8 diagrammatically shows another equipment for carrying out the invention, adapted for the treatment of ready-made articles, such as T-shirts, on which it is desired to reproduce some design or other. In this figure:

60 represents a suitable mould, intended to receive the T-shirt 61 and to place the part to be printed 62 of this latter over a hole 63, worked into the mould 60 for this purpose;

64 securing means for putting the article 61 into place and placing it under tension;

65 a press, which can be raised, the centre 66 of which is cut out, so as to allow penetration of treatment liquids;

67 an element for spraying the photosensitive composition;

68 an element for exposure to light;

69 a rinsing element 70 a hot air inlet, intended for application to 66 and to 62, the said hot air escaping through 71 after its action.

The operation proceeds in the following ways:

The article 61 to be treated is fixed to the station 72. Once the press 65 is lowered, the mould 60 is automatically shifted by conventional means (not shown) to the spraying-station 73, then from there to the irradiation station 74, subsequently to the rinsing station 75 and, finally, to the drying station 76. Once the cycle is concluded, the mould 60 is strilled, then is automatically returned to 72 in the direction indicated by the arrows. The cycle then re-starts.

Evacuation of treatment liquids and of hot air is effected, as has already been said, in the direction indicated by the arrows, to 71.

EXAMPLE 10

Example 1 is repeated, the device, illustrated in outline in FIG. 9, being used. For this purpose, the textile article to be treated, for example a cotton T-shrt, is placed, first of all, on a perfectly tight frame, carrying a metal grid, placed on a receiver, connected to a recovery channel. This horizontally arranged grid 100 can be shifted sideways between three working-posts, represented in outline by the reference numbers 101, 102, 103, going from left to right.

Subsequently, the grid 100 is shifted sideways to the right, so as to enable the textile article to be covered with a coating layer, and this with the aid of a row of nozzles 104, connected by piping to a reservoir of colouring compositions 105 under pressure.

The grid 100 is then shifted, the coated textile article being held towards the left and the drying equipment 106 is applied to this article, cold air being used for drying.

Subsequently, the negative film is placed by hand on the grid 100 and is covered with a glass, plate, so as to ensure satisfactory smoothness of the assembly.

Subsequently, the assembly is shifted to the right to the station 103, so as to expose it under a set of rows of actinic tubes.

When exposure is terminated, the assembly is shifted to the left, then the negative and the glass plate are removed. The coat of irradiated composition is then washed with the aid of a brush 107, connected, first of all, to a source of tepid water 108, then it is rinsed with the aid of soap water under pressure, contained in a receiver 109, and, finally, again washed with tepid water. Changeover from tepid water to soap water is carried out by means of a valve 110.

Finally, it is dried by means of the same blower 106, supplied with hot air this time.

The process of the invention shows numerous advantages, in relation to the processes hitherto known, particularly such as:

ease of application;

convenient storage;

large choice of possible and readily available formats;

photographic reproduction with all the resulting advantages: precision of detail, possibility of reeling, of toning down etc; possibility of trichromatic reproduction in a single exposure; use on a large number of substrates, textile or other, plastics etc.

A knowledge of the teachings of British Patent Specification No. 864 829 and of French Patent Specification No. 2 304 101, cited in the preamble, did not enable those skilled in the art to arrive at the invention. In fact, if the intended purpose is the same, ie colour printing, the physical or chemical processes applied are different. Besides, the combination of these two teachings was not obvious; for in one case, the coloured image was obtained by selective deposition of the composition, while, in the other case, it was obtained by selective explosure to ultraviolet light, Finally, the process according to the invention, in contrast to these two processes, is rapid, economical and has wide spectral sensitivity in the visible and in the ultraviolet range.

It is obvious that the above examples have only been given by way of illustration and that it would be possible for all those skilled in the art to modify them, especially by substituting an equivalent technique, without, as a result, departing from the scope of the invention.

We claim:

1. An improved process for colour printing textile articles chosen from the group formed by cloths, garments and textile accessories, in which:

at least one coat, in basic medium, of a photosensitive composition, comprising at least one triazene of general formula:

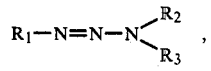

in which $R_1$, $R_2$ and $R_3$ are chosen from the group consisting of hydrogen, an alkyl radical or an aryl radical, and a coupling agent, capable of yielding an azo dye colour by reaction with a diazonium cation obtained by photochemical decomposition of the triazene by exposure to light, is applied to a suitable surface of the textile article to be printed, then the said coat is exposed to light with a suitable negative image, wherein the improvement consists of washing and rinsing the coated textile article after said exposure to remove unreacted chemical products and then drying the coated textile article.

2. Process according to claim 1, characterised in that $R_1$ is an aromatic radical, $R_2$ denotes hydrogen or an alkyl radical and $R_3$ an alkyl or aryl radical.

3. Process according to claim 1, characterised in that the photosensitive composition, in addition, contains at least one of the constituents, chosen from the group formed by:

viscosity-modifying agents, capable of being removed on washing;

complexing agents, intended for statilising the triazene and the dye formed;

agents for adjusting the oxidation/reduction equilibrium of the mixture;

agents capable of photochemically causing a lowering of the pH of the medium.

4. Process according to claim 1, characterised in that the photosensitive composition, in addition, contains:

at least one sensitizing agent for the decomposition of the triazene in visible light;

at least one compound, polymerisable under the influence of irradiation and of the sensitizing agent and intended for fixing the dyem formed.

5. Process according to claim 1, in which several superimposed coats, each containing colour-generating compound are applied to the surface of the textile articles, characterized in that:

a first photosensitive coating, formed by a composition, based on a triazene and on a coupling agent, capable of yielding a first fundamental azo dye colour on exposure to actinic light, is applied, the coat obtained is then exposed, with a chosen design to actinic light through a first three-colour selection negative corresponding to the colour yielded by this first composition, then it is washed and rinsed;

subsequently, a second photosensitive coating, formed by a composition, based on a triazene and on a coupling agent, capable of yielding a second fundamental azo dye colour on exposure to actinic light, is applied, then this second coat is exposed, with a chosen design, to actinic light through a second three-colour selection negative, corresponding to the colour yielded by this second composition, then it is washed and rinsed;

after that, a third photosensitive coating, formed by a composition, based on a triazene and on a coupling agent, capable of yielding a third fundamental azo dye colour on exposure to actinic light, is applied, then this third coat is exposed, with a chosen design, to actinic light through a third three-colour selection negative, corresponding to the colour yielded by this third composition, then it is washed and rinsed;

and, finally, the textile article obtained is dried.

6. Process according to claim 1, in which three superimposed coats, each containing colour-generating compounds are applied to the surface of the textile article to be printed, characterized in that first of all, a first photosensitive coating, consisting of a composition, containing at least one triazene and one coupling agent, capable of yielding a first complementary azo dye colour to the sensitizing colour on exposure to light, a sensitizing agent and at least one compound, polymerisable under the influence of exposure to light, so as to fix the first dye formed, is applied;

then a second photosensitive coating, consisting of another composition, containing at least one triazene and one coupling agent, capable of yielding a second complementary azo dye colour to the sensitizing colour on exposure to light, a sensitizing agent and at least one compound, polymerisable under the influence of exposure to light, so as to fix the second dye formed, is applied to the first coat;

then a third photosensitive coating, consisting of another composition, containing at leat one triazene and one coupling agent, capable of yielding a third complementary azo dye colour to the sensitizing colour on exposure to light, a sensitizing agent and at least one compound, polymerisable under the influence of exposure to light, so as to fix the third dye formed, is applied to the second coat;

subsequently, these superimposed three coats are exposed to light through a colour negative of the image to be reproduced; subsequently, washing is carried out with a compound, which is a solvent of the unreacted compounds, but a non-solvent of the polymers formed by polymerisation;

and, finally, the textile article obtained is dried in conditions adequate for removing the solvents and fixing the three coats obtained.

7. Process according to claim 6, characterised in that irradiation is effected with visible light.

8. Process according to claim 3, characterised in that the agents, capable of photochemically causing a lowering of the pH of the medium and aiding in the decomposition of the triazene in the irradiated zones, are chosen from the group, consisting of trimethoxyboroxine, phosphoro-phenyl dihydrochloride, orthonitrobenzaldehyde, halogenated hydrocarbons, hydroxylamine hydrochloride and p-sulphonyl nitrobenzene chloride.

9. Process according to claim 1, characterised in that the photosensitive composition is formed by inert pigment particles in the working conditions, enveloped by a composition containing at least one triazene, one coupling agent, capable of yielding a fundamental colour on exposure to light, and a sensitizing agent and a compound, polymerisable under the influence of irradiation and of the sensitizing agent.

10. Process according to claim 2, characterized in that the alkyl or aryl radicals of $R_3$ are substituted by solubilizing groups chosen in the group consisting of —COOH and —$SO_3H$ groups.

* * * * *